US009416624B2

(12) United States Patent
Williamson

(10) Patent No.: US 9,416,624 B2
(45) Date of Patent: Aug. 16, 2016

(54) PRESSURE-OPERATED DIMPLE LOCKOUT TOOL

(75) Inventor: Jimmie Robert Williamson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/401,723

(22) PCT Filed: Jul. 18, 2012

(86) PCT No.: PCT/US2012/047126

§ 371 (c)(1),
(2), (4) Date: Feb. 17, 2015

(87) PCT Pub. No.: WO2014/014451

PCT Pub. Date: Jan. 23, 2014

(65) Prior Publication Data

US 2016/0024886 A1 Jan. 28, 2016

(51) Int. Cl.

| | |
|---|---|
| ***E21B 34/14*** | (2006.01) |
| ***E21B 23/01*** | (2006.01) |
| ***E21B 34/06*** | (2006.01) |
| ***E21B 34/10*** | (2006.01) |
| *E21B 34/00* | (2006.01) |

(52) U.S. Cl.

CPC ..... *E21B 34/14* (2013.01); *E21B 23/01* (2013.01); *E21B 34/063* (2013.01); *E21B 34/103* (2013.01); *E21B 2034/005* (2013.01)

(58) Field of Classification Search

CPC . E21B 34/14; E21B 2034/005; E21B 34/063; E21B 34/101; E21B 34/102; E21B 34/103
See application file for complete search history.

(56) References Cited

U.S. PATENT DOCUMENTS 4,449,587 A * 5/1984 Rodenberger ..... E21B 34/102 166/323
4,574,889 A * 3/1986 Pringle ..... E21B 34/102 166/323
4,577,694 A * 3/1986 Brakhage, Jr. ..... E21B 34/14 166/323
4,624,315 A * 11/1986 Dickson ..... E21B 34/102 166/323
4,977,957 A * 12/1990 Pringle ..... E21B 34/10 166/321
5,249,630 A 10/1993 Meaders et al.
6,059,041 A * 5/2000 Scott ..... E21B 23/00 166/323
6,125,930 A * 10/2000 Moyes ..... E21B 34/066 166/317
6,575,249 B2 * 6/2003 Deaton ..... E21B 34/102 166/332.8
6,902,006 B2 6/2005 Myerley et al.
6,991,040 B2 * 1/2006 Hill, Jr. ..... E21B 34/102 166/323
7,137,452 B2 * 11/2006 McVicker ..... E21B 34/102 166/316
7,360,600 B2 4/2008 MacDougall et al.
7,409,996 B2 * 8/2008 Myerley ..... E21B 23/02 166/323
7,717,185 B2 * 5/2010 Anderson ..... E21B 34/102 166/332.8
2002/0170719 A1 11/2002 Deaton
2003/0075336 A1 * 4/2003 Dennistoun ..... E21B 29/08 166/373
2004/0007365 A1 * 1/2004 Hill, Jr. ..... E21B 34/102 166/386
2004/0056224 A1 * 3/2004 McVicker ..... E21B 34/102 251/62
2009/0114389 A1 * 5/2009 Dennistoun ..... E21B 29/08 166/277
2010/0006296 A1 * 1/2010 Anderson ..... E21B 34/102 166/332.8

OTHER PUBLICATIONS

International Search Report and Written Opinion for PCT/US2012/047126 dated Mar. 19, 2013.

* cited by examiner

*Primary Examiner* — James G Sayre
(74) *Attorney, Agent, or Firm* — McDermott Will & Emery LLP; Scott Richardson

(57) ABSTRACT

The disclosure describes a lockout tool including a cam housing configured to fit within a flow tube of a safety valve that is coupled to production tubing and has a longitudinal up-down axis. The lockout tool further includes a piston disposed within the cam housing and configured to move within the cam housing parallel to the longitudinal up-down axis and form a plurality of dimples in the flow tube upon provision within the production tubing of a pressurized fluid.

19 Claims, 13 Drawing Sheets

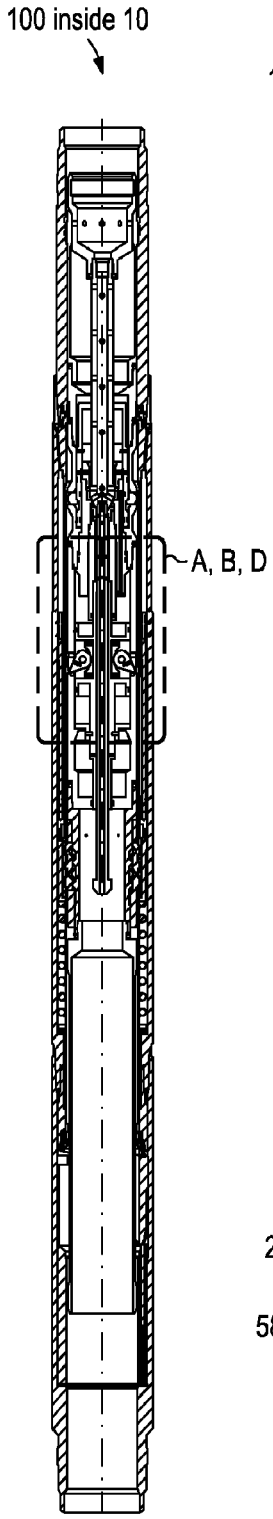
FIG. 11
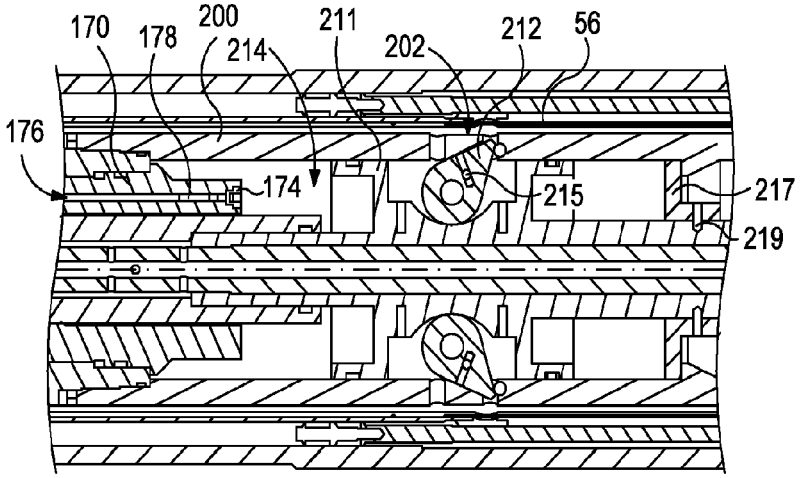
FIG. 11A
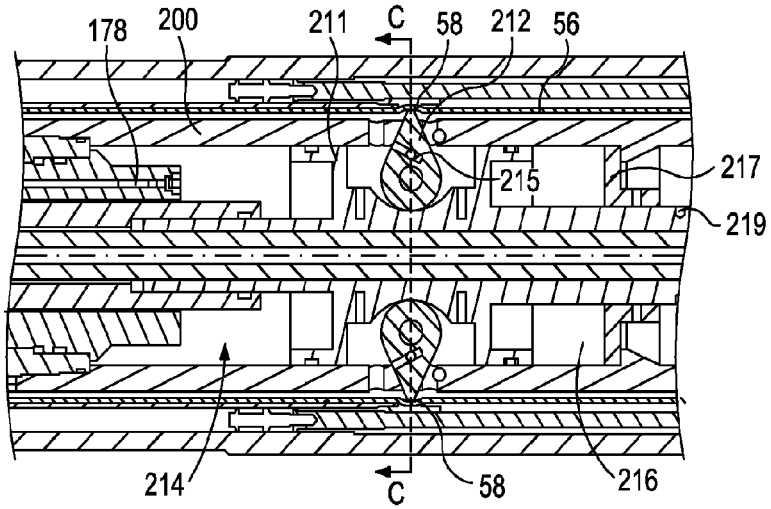
FIG. 11B
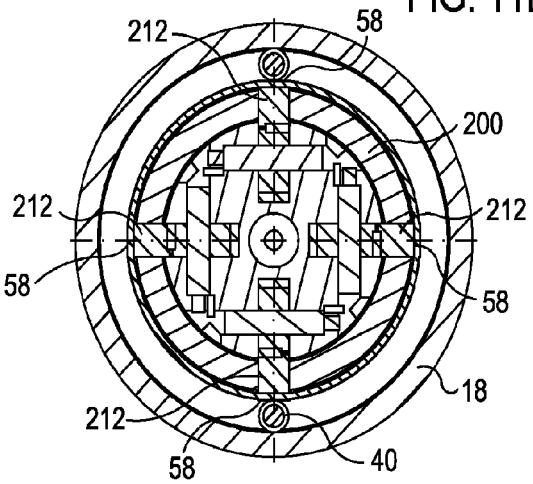
FIG. 11C (section C-C from 11B)

PRESSURE-OPERATED DIMPLE LOCKOUT TOOL

BACKGROUND

The present invention relates to downhole wellbore operations and, in particular, to systems and methods of permanently locking open a Sub-Surface Safety Valve (SSSV).

A typical oil or gas well includes a SSSV to provide the ability to shut off the flow of the oil and/or gas at a point below the surface to avoid an uncontrolled release of the oil and/or gas, or "blow out," in the event of damage to surface components of the well. A SSSV typically includes a flapper valve configured to open downward and, when closed, to seal against a valve seat so as to prevent upward flow through the SSSV.

A Tubing Retrievable Safety Valve (TRSV) is one type of SSSV that is run and retrieved as part of the production tubing string. A TRSV may be located near the surface in a land-based well or at a depth of 1000 feet or more in a subsea well. A hydraulic control line typically runs in parallel to the production tubing and connects to the TRSV to control the operation of the TRSV. The flapper of the TRSV is held open when pressure is provided through the control line, and loss of pressure in the control line causes the flapper to close. A "slim-line" version of a TRSV provides a relatively large flow inner diameter in relation to the outer diameter of the TRSV body.

One problem sometimes encountered with a TRSV is that the mechanism of the TRSV may become damaged or clogged, for example, by debris within the oil or action of hot, corrosive oil, and as a result the TRSV no longer operates properly. Replacing a TRSV is a complex and difficult task and it is sometimes desirable to leave the malfunctioning TRSV in place and disable the TRSV by locking the flapper in an open position. One method of disabling a TRSV is to lock the flow tube of the TRSV in the extended position so that the flow tube retains the flapper in the open position. What is needed is a reliable means of opening the flapper, extending the flow tube, and then deforming the flow tube so as to interfere with other features of the TRSV thereby locking the flow tube in the extended position.

SUMMARY OF THE INVENTION

The present invention relates to downhole wellbore operations and, in particular, to systems and methods of permanently locking open a Sub-Surface Safety Valve (SSSV).

In certain aspects, a method of locking open a safety valve is disclosed herein. The method includes the step of forming simultaneously a plurality of dimples in a flow tube of a safety valve using a lockout tool having a cam housing and a piston disposed within the cam housing, the lockout tool being configured to move relative to the cam housing parallel to a longitudinal up-down axis of the safety valve upon provision of a pressurized fluid within production tubing that is coupled to the safety valve.

In certain aspects, a lockout tool is disclosed that includes a cam housing that is configured to fit within a flow tube of a safety valve that is coupled to production tubing and has a longitudinal up-down axis and a piston that is disposed within the cam housing and configured to move within the cam housing parallel to the longitudinal up-down axis and form a plurality of dimples in the flow tube upon provision within the production tubing of a pressurized fluid.

In certain aspects, a lockout tool is disclosed that includes a cam housing configured to fit within a flow tube of a safety valve that is coupled to production tubing. The flow tube includes an upper flow tube coupled to a center element having an exercise key profile. The lockout tool also includes an exercise key movably coupled to the cam housing and configured to selectably engage the exercise key profile, an opening prong fixedly coupled to the cam housing and configured to move a flapper of the safety valve to an open position and allow the flow tube to move to an extended position that generally retains the flapper in the open position, and a piston body disposed within the cam housing so as to be generally within the upper flow tube when the lockout tool is operably disposed within the safety valve and the flow tube is in the extended position. The piston body is configured to move within the housing parallel to a longitudinal up-down axis of the safety valve when a pressurized fluid is provided through the production tubing. The lockout tool also includes a plurality of cams rotatably coupled to the piston body. The plurality of cams each comprise a high point and are configured to synchronously rotate as the piston body moves relative to the cam housing such that the high points each locally deform the upper flow tube.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

FIG. 11 and the enlarged views FIGS. 11A-11E show incremental configurations of the exemplary lockout tool disposed in the safety valve during a fifth step in the dimpling operation, according to certain aspects of the present disclosure.

DETAILED DESCRIPTION

Figure 1:
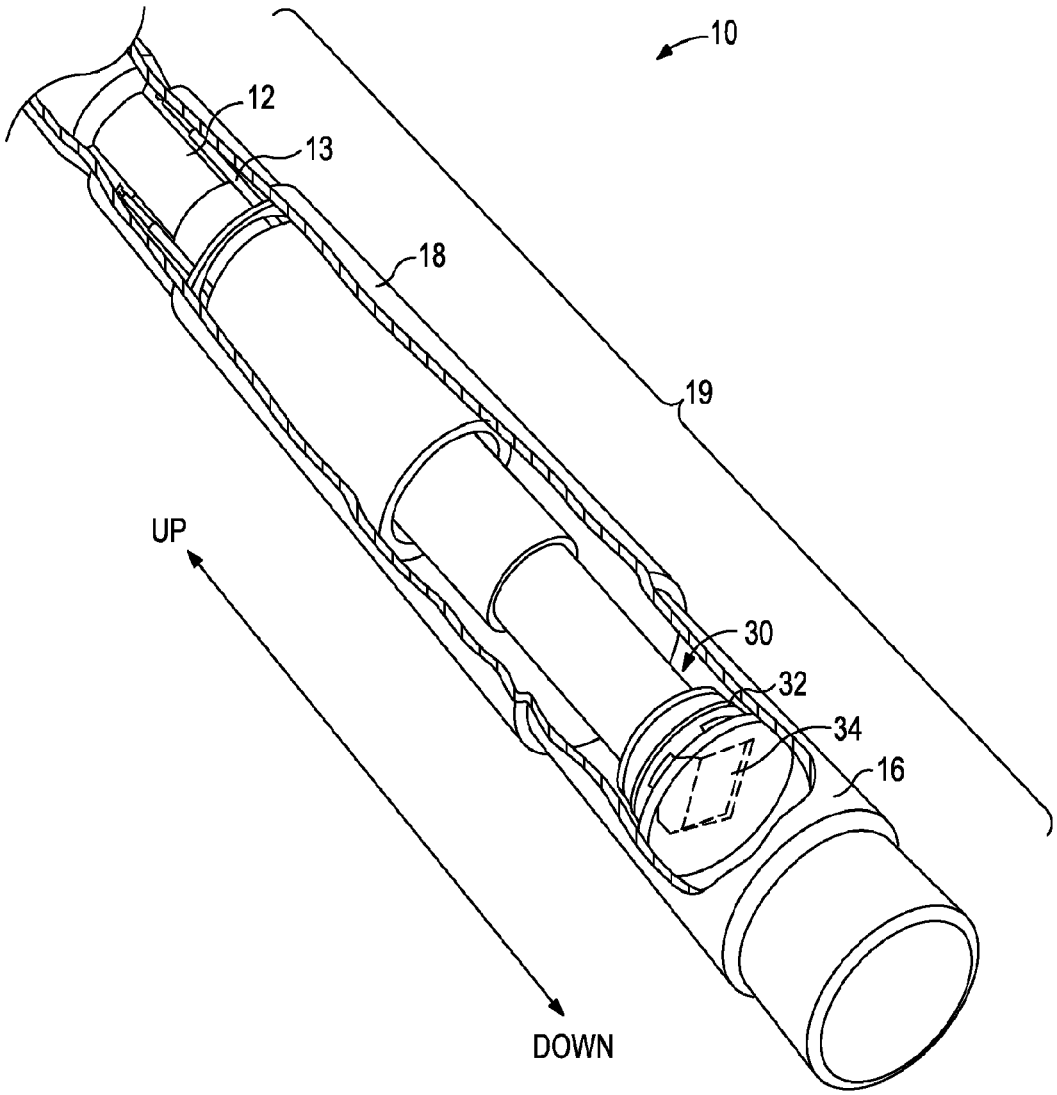
FIG. 1 depicts an example safety valve with a valve assembly that includes a flapper and a valve seat, according to one or more embodiments.

The present invention relates to downhole wellbore operations and, in particular, to systems and methods of permanently locking open a Sub-Surface Safety Valve (SSSV).

The lockout tool disclosed herein provides a method and system for forming a plurality of dimples in a flow tube of a safety valve for the purpose of locking the safety valve in an open position. The dimples are formed by a mechanism driven by the controlled application of pressure provided through the production tubing. In certain embodiments, the dimples are formed by cams that rotate as a sliding body moves downward within the lockout tool, wherein the cams protrude sufficiently from the lockout tool to locally deform the flow tube. In certain embodiments, the lockout tool incorporates no-go features to prevent the tool from damaging the safety valve. In some embodiments, the method and system provide feedback to the operators on the surface of successful execution of certain steps in the dimpling process, thereby increasing the confidence of using the lockout tool. In certain embodiments, the method and system provide for emergency removal of the lockout tool at any step during the dimpling process.

The embodiment of the lockout tool disclosed herein is adapted for use with the particular embodiment of a safety valve disclosed herein. Other safety valve designs may accomplish the same functions of opening and closing an upwardly closing flapper. It will be apparent to those of skill in the art that the principles disclosed herein with regard to this particular embodiment of a safety valve can be applied to design lockout tools for other embodiments of a safety valve, without departing from the scope of the disclosure. Accordingly, nothing in this disclosure should be interpreted to limit the lockout tool or the method of forming a dimple to this particular embodiment of a safety valve.

One advantage of the disclosed methods and systems is that the exemplary lockout tool interacts with existing and standard features of the safety valve, whereas some conventional lockout tools require provision of special features in the safety valve and thus can only be used with safety valves that are equipped with those special features. To the contrary, the disclosed lockout tool is compatible with certain standard models of safety valves such that the disclosed lockout tool is backward compatible with installed safety valves of these standard models.

Another advantage of the disclosed lockout tool over conventional dimpling tools is that some conventional tools attempt to form a single dimple in the flow tube, or to form multiple dimples one at a time. As the wall of the flow tube is thin in comparison to its diameter, the wall is flexible and may distort from the circular profile into an egg-shaped profile when a conventional tool attempts to form a single dimple. When this happens, the dimple is either smaller than intended or, in a worst case, is not formed at all. Forming multiple dimples simultaneously addresses this shortcoming of conventional tools by applying the forces simultaneously in different widely separated positions which reduces the ability of the thin wall to distort and therefore improves the reliability of the dimple forming process.

Another advantage of the disclosed lockout tool over conventional dimpling tools is that the disclosed lockout tool is driven by pressure provided through the production tubing rather than slickline jarring as is required to operate some conventional lockout tools. As such, the disclosed lockout tool is simpler and easier to deploy down the well and is more reliable as a number of potential failure points are eliminated.

To facilitate a better understanding of the present invention, the following example of an exemplary embodiment of a lockout tool is provided. In no way should the following examples be read to limit, or to define, the scope of the invention.

Within this document, the phrases "safety valve," "subsurface safety valve," and "tubing retrievable safety valve" and the acronyms "SSSV" and "TRSV" mean any safety valve deployed as part of a production string and are to be considered equivalent and therefore interchangeable. The exemplary safety valve disclosed herein is only an example and the concepts and principles of design and operation may vary without departing from the scope of this disclosure.

As used herein, the phrase "production tubing" means the connected series of components that conveys oil and/or gas or other fluids being extracted from an underground reservoir. Production tubing may include devices used in conjunction with production tubing such as, but not limited to, a packer or slip joint in addition to tubing.

As used herein, the phrases "jarring down" and "jarring up" and variations thereof are given the particular meanings associated with operation of downhole equipment in an oil and/or gas well. In particular, "jarring up" means that an upward impulse of force is applied to an element and "jarring down" means that a downward impulse of force is applied to the element.

As used herein, the phrase "flow tube" means an element that is extended to open a flapper or maintain a flapper in its open position. Elements with this function are sometimes referred to as a "control sleeve." In an alternate embodiment of a safety valve that utilizes a different type of element to hold the flapper open, any portion of the element that may be deformed so as to prevent motion of the element is considered equivalent to the structure of the flow tube disclosed herein.

As used herein, the term "dimple" refers to a local portion of a section of a flow tube that is permanently displaced from its original profile. In the disclosed examples, the portion of the flow tube is a thin-walled cylindrical tube and the dimple is a round-topped conical deformation. In certain embodiments, dimples may have other shapes, for example a four-sided pyramid or a deformation having a shallow-angle ramp on one face and steep-angle ramps on other faces and the deformed thin-walled element may have other profiles such as hexagonal or any other polygonal shape.

As used herein, the term "lock open" or similar indicates that a movable device having an open position has been retained in or near the open position by a modification to the movable device or placement of a secondary device, such as a flow tube, so as to prevent the movable device from a large departure from the open position. In some embodiments, the movable device may be allowed to move some distance from the open position, for example ten percent of the motion required to move from the open position to a closed position, and nonetheless still be considered to be in the locked open position of the movable device.

The safety valve 10 and/or lockout tool 100 may include numerous seals to provide pressure-sealing capability between separate parts, fittings and fasteners to join separate parts, and multiple components that are manufactured separately, for example, for ease of manufacture, and assembled to provide certain elements of the safety valve 10 and/or lockout tool 100. Within this document and the associated drawings, multiple components may be provided with a single reference identifier to indicate that the components are considered as a single functional element although, in certain embodiments, they may be fabricated as separate parts and assembled. In addition, the materials from which the various components of the safety valve 10 and/or lockout tool 100 are fabricated are selected based on the function, design, and service environment. The details of these type of features are known to those of skill in the art and are not described herein so as not to obscure the disclosure.

FIG. 1 depicts an example safety valve 10 with a valve assembly 30 that includes a flapper 34 and a valve seat 32. The valve assembly 30 is located within a housing 19 that includes a top sub 18 and a bottom sub 16. The safety valve 10 has a longitudinal up-down axis as shown in FIG. 1 and the upper end of the top sub 18 is configured to sealingly mate with a production tubing 12 through which the oil and/or gas flows out of the well. One or more control lines 13 run parallel to the production tubing 12 and connect to a control line port 18A (not shown in FIG. 1). Control of the safety valve through the pressure in the control line 13 is discussed in greater detail below with respect to FIGS. 3 and 4.

Figure 2:
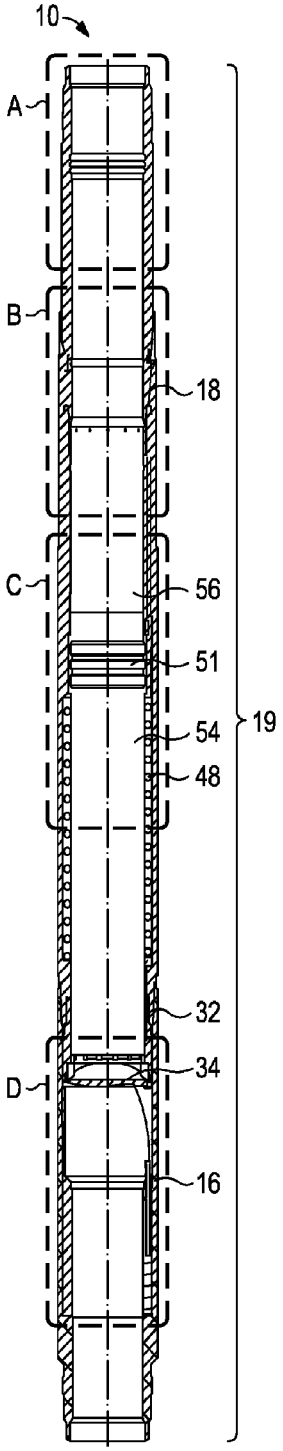
FIG. 2 and the enlarged views in FIGS. 2A-2D are cross-sections of an exemplary safety valve, according to certain aspects of the present disclosure.

FIG. 2 and the enlarged views in FIGS. 2A-2D are cross-sections of an exemplary safety valve 10, according to certain aspects of the present disclosure. The safety valve 10 has a housing 19, which includes a top sub 18 and a bottom sub 16, and a flow tube 50, which includes a center element 51, a lower flow tube 54, and an upper flow tube 56. A closure spring 48 is located in the housing 19 and pushes the center element 51 upward. Portions A, B, C, and D of the safety valve 10, as identified in FIG. 2, are shown in enlarged cross-sectional views in FIGS. 2A-2D, respectively.

Figure 2A:
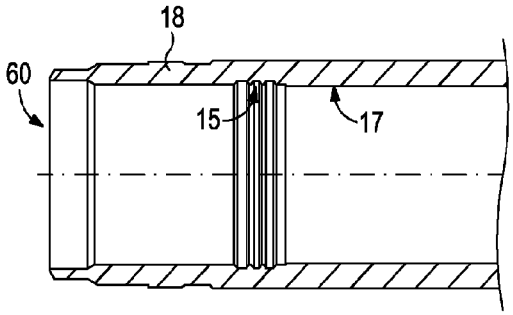

FIG. 2A is a cross-section of the portion of the safety valve 10 indicated by the dashed line box A in FIG. 2. FIG. 2A depicts the upper end of the top sub 18 where a no-go profile 15 is provided on the interior surface of the flow path 60 of the safety valve 10, according to certain aspects of the present disclosure. In some embodiments, the profile 15 is a proprietary RPT® no-go profile commercially-available through Halliburton Energy Services of Houston, Tex., USA. Below the no-go profile 15 is a honed bore 17 that is controlled in diameter and surface finish so as to provide a suitable surface for engagement of sealing features of various tools, such as the exemplary lockout tool disclosed herein.

Figure 2B:
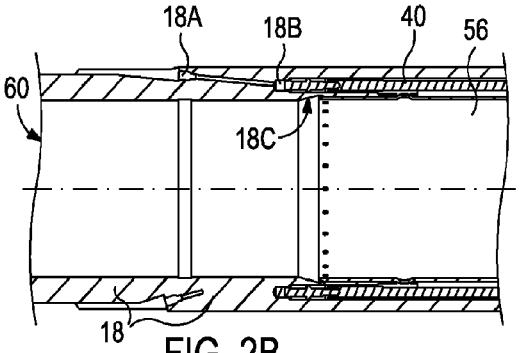

FIG. 2B is a cross-section of the portion of the safety valve 10 indicated by the dashed line box B in FIG. 2. FIG. 2B depicts the control line port 18A and its connection to a drilled passage 18B in the top sub 18 in which is located an actuation rod 40, according to certain aspects of the present disclosure. It can be seen that the inner diameter of the flow path 60 may increase just below the control line port 18A and that the upper flow tube 56 is sized such that the inner diameter of the upper flow tube 56 is the same as and aligned with the flow path 60 to provide a smooth flow path. The upper flow tube 56 is shown in FIG. 2B in the retracted position within a recess 18C in the inner wall of top sub 18.

Figure 2C:
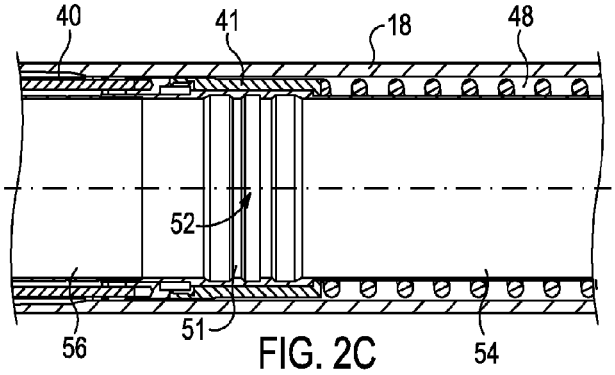

FIG. 2C is a cross-section of the portion of the safety valve 10 indicated by the dashed line box C in FIG. 2. FIG. 2C depicts a forcing ring 41 that engages the center element 51, according to certain aspects of the present disclosure. The actuation rod 40 and the closure spring 48 engage opposite sides of the forcing ring 41. Providing hydraulic pressure to the control line 13 (not shown in FIG. 2C) will force actuation rod 40 downward, thereby forcing the forcing ring 41 and the flow tube 50 downward, and releasing the pressure in control line 13 will allow the closure spring 48 to force the forcing ring 41 and flow tube 50 upward.

Figure 2D:
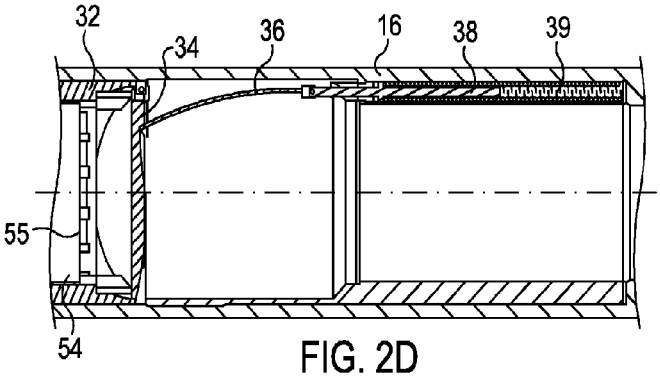

FIG. 2D is a cross-section of the portion of the safety valve 10 indicated by the dashed line box D in FIG. 2. FIG. 2D depicts the valve assembly 30 with the flapper 34 in the closed position against the valve seat 32, according to certain aspects of the present disclosure. A flapper arm 36 may be in contact with the underside of the flapper 34 and also in contact with a flapper piston 38 that may be configured to engage a flapper spring 39. Once the flow tube 50 is retracted, as generally described above, the combined action of the flapper arm 36, flapper piston 38, and flapper spring 39 may result in urging the flapper 34 towards the closed position. The lower edge 55 of the lower flow tube 54 is visible at the left of FIG. 2D, with the flow tube 50 shown in the retracted position.

Figures 3, 4, 5:
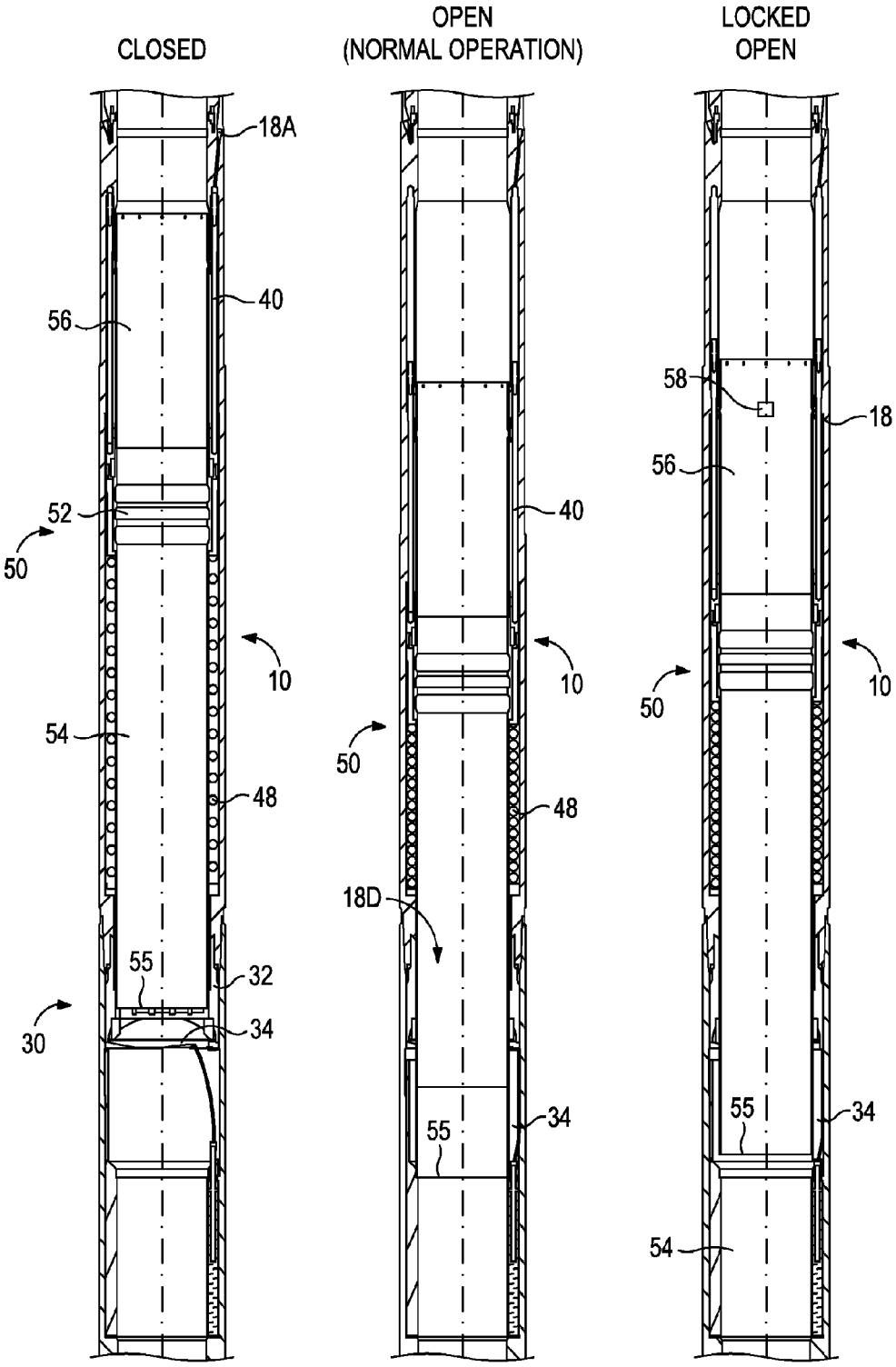
FIG. 3 is a partial cross-section of the safety valve in the closed position, according to certain aspects of the present disclosure.
FIG. 4 is a partial cross-section of the safety valve in the open position during normal operation of the safety valve, according to certain aspects of the present disclosure.
FIG. 5 is a partial cross-section of the safety valve in the locked-open position after completion of a dimpling operation by a lockout tool as disclosed herein, according to certain aspects of the present disclosure.

FIG. 3 is a partial cross-sectional view of the safety valve 10 in the closed position, according to certain aspects of the present disclosure. As illustrated, the flow tube 50 is in its retracted position, thereby allowing the flapper 34 to move to its closed position.

FIG. 4 is a partial cross-sectional view of the safety valve 10 in the open position during normal operation of the safety valve 10, according to certain aspects of the present disclosure. As illustrated, the flow tube 50 is in its fully extended position, wherein the lower edge 55 of the flow tube 50 has extended past and below the flapper 34, thereby forcing the flapper 34 open and maintaining the flapper 34 in its open position. The flow tube 50 in its extended position also protects the flapper 34 from accumulating debris within the oil and/or gas flowing through the flow path 60 of the safety valve 10. As briefly described above, the closure spring 48 is compressed by downward motion of actuation rod 40 under pressure provided through the control line 13.

FIG. 5 is a partial cross-sectional view of the safety valve 10 in the locked-open position after completion of a dimpling operation by the lockout tool 100 described below with reference to FIG. 6 and as disclosed herein according to certain aspects of the present disclosure. Briefly, one or more dimples 58 may be formed at the upper flow tube 56 of the flow tube 50 which may be configured to interfere with features on the inside surface of the top sub 18, thereby preventing the flow tube 50 from retracting. The flow tube 50 is partially extended in this example, and the amount of extension is sufficient such that the lower flow tube 54 still maintains the flapper 34 in its open position.

Figure 6:
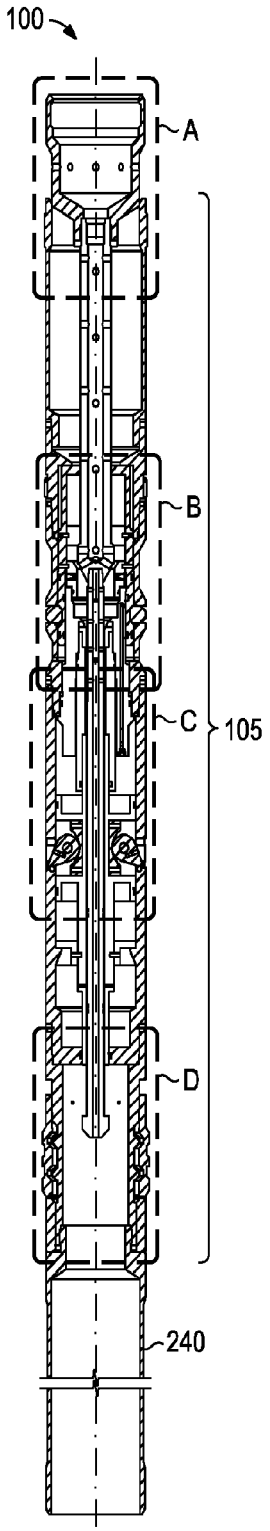
FIG. 6 and the enlarged views in FIGS. 6A-6D show an exemplary lockout tool disposed in the safety valve, according to certain aspects of the present disclosure.

FIG. 6 and the enlarged views in FIGS. 6A-6D show an exemplary lockout tool 100, according to certain aspects of the present disclosure. The lockout tool 100 may include an outer shell 105 that has an upper guide 130, a lower guide 140, a lug carrier 150, a cam housing 200, and a key expander mandrel 230. The lockout tool 100 may also include an opening prong 240 coupled to the lower end of the outer shell 105 and configured to open the flapper 34 of the safety valve 10. Details of the various portions of the lockout tool 100 are shown in FIGS. 6A-6D.

Figure 6A:
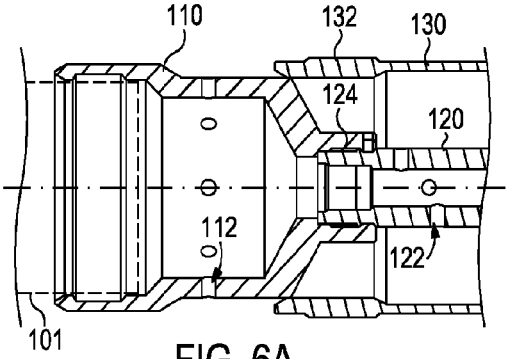

FIG. 6A is a cross-sectional view of the portion of the lockout tool 100 indicated by the dashed line box A in FIG. 6. FIG. 6A depicts a fishing neck 110 that may be attached to a plunger shaft 120 via a threaded coupling 124. The plunger shaft 120 may be contained within or otherwise arranged inside an upper guide 130 that may have a no-go stop 132 near its upper end. It can be seen that the plunger shaft 120 contains multiple flow passages 122 (two shown) allowing fluid to pass from the central bore of the plunger shaft 120 to the interior of the upper guide 130. The fishing neck 110 may also have multiple flow passages 112 allowing fluid to pass through the walls of the fishing neck 110.

Figure 6B:
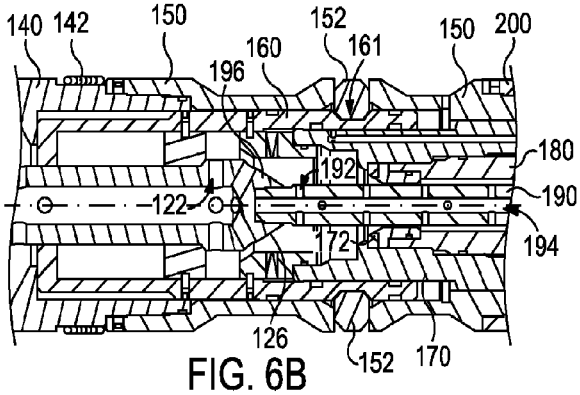

FIG. 6B is a cross-sectional view of the portion of the lockout tool 100 indicated by the dashed line box B in FIG. 6. The upper-guide 130 in FIG. 6A connects to a lower guide 140, visible at the left side of FIG. 6B, which may then be connected to a lug carrier 150, which then connects to a cam housing 200 at the right edge of FIG. 6B. In at least one embodiment, the lug carrier 150 may have a plurality of lugs 152 (two shown) that are shown in the retracted position in FIG. 6B. Inside the lug carrier 150 is a lug expander 160 that may define shaped recesses 161 corresponding to and otherwise arranged underneath the lugs 152. The lug expander 160 may be configured to surround a pressure plug 170 that surrounds a core piston guide 180, inside of which is nested an emergency extraction shaft 190. There is a central passage 194 that is defined in or otherwise passing through the center of the emergency extraction shaft 190 and is communicably connected to the outside areas through one or more flow passages 192 defined in the extraction shaft 190. One or more pressure seals 172 may be arranged at the upper end of the pressure plug 170 and it can be seen that there is a gap between the nose seal surface 126 of the plunger shaft 120 and the pressure seal 172 in this configuration.

Figure 6C:
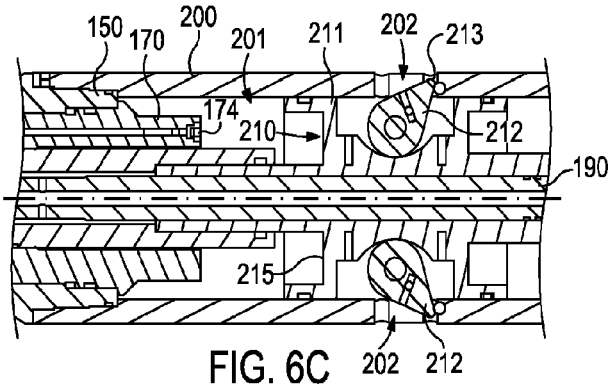

FIG. 6C is a cross-sectional view of the portion of the lockout tool 100 indicated by the dashed line box C in FIG. 6. FIG. 6C depicts the lower end of pressure plug 170 which may include a burst disc 174. The lug carrier 150 may be connected to the cam housing 200 and define a central bore 201 in which a cam piston 210 may be movably arranged. As illustrated, the cam piston 210 may have a piston body 211 and one or more cams 212 (two shown) that are rotatably coupled to the piston body 211. Each cam 212 may define a high point 213 and may be coupled to the body 211 such that the respective high points 213 protrude in certain orientations through corresponding cam openings 202 defined in the cam housing 200 during a portion of the rotation of the cams 212 with respect to the piston body 211.

Figure 6D:
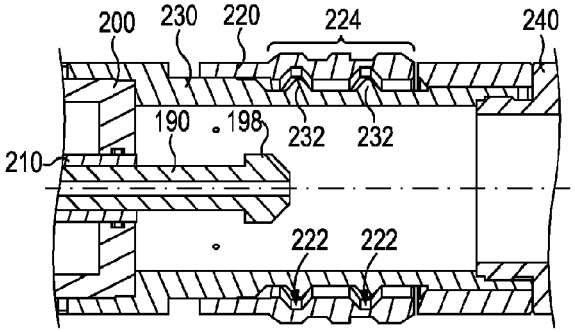

FIG. 6D is a cross-sectional view of the portion of the lockout tool 100 indicated by the dashed line box D in FIG. 6. FIG. 6D depicts a lower end of the cam housing 200, where the emergency extractor shaft 190 protrudes through the center of the cam housing 200. As illustrated, the emergency extractor shaft 190 may have a flared end 198 at its lower end. In some embodiments, the cam housing 200 may connect to a key expander mandrel 230, which is surrounded by an exercise key 220. In at least one embodiment, the exercise key 220 may have two relief clearances 222 formed on the inner surface and the key expander mandrel 230 may have two matching key expander ridges 232 that may be located directly beneath the relief clearances 222. At the lower end of the exercise key 220, the opening prong 240 may be attached to the key expander mandrel 230.

Figure 7:
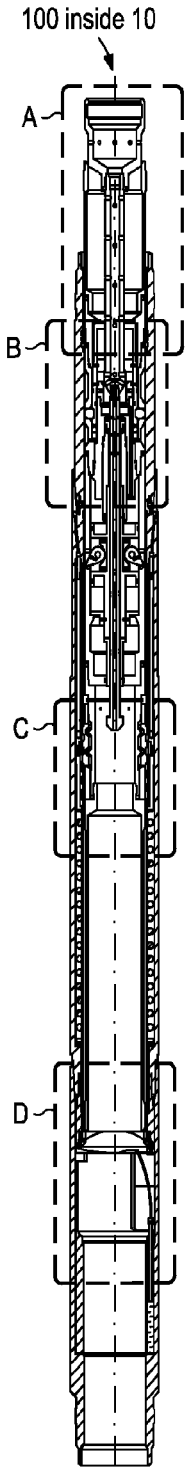
FIG. 7 and the enlarged views in FIGS. 7A-7D show the exemplary lockout tool disposed in the safety valve and configured for a first step in the dimpling operation, according to certain aspects of the present disclosure.

FIG. 7 and the enlarged views in FIGS. 7A-7D show the exemplary lockout tool 100 disposed in the safety valve 10 and configured for a first step in the dimpling operation, according to certain aspects of the present disclosure. FIG. 7 shows the lock-out tool 100 located within the safety valve 10. As initially inserted with the flapper 34 closed, the lock-out tool 100 will come to rest with the lower edge 55 of the lower flow tube 54 in contact with the flapper 34. There may be a first pressure below the flapper 34 that is higher than a second pressure in the flow path 60 above the flapper valve 34. FIGS. 7A-7D show how a flow path exists from the outside of the fishing neck 110 (FIG. 6A) to the flapper 34, thereby allowing pressure in the production tubing 12 (FIG. 1) to reach the flapper 34. This allows the operators on the surface to equalize the pressure on both sides of the flapper 34, which would otherwise prevent the flapper 34 from opening, by pressurizing the production tubing 12. After the pressure is approximately equal on both sides of flapper 34, downward jarring on the toolstring and/or the weight of the lockout tool 100 and attached elements may exert enough force to extend the flow tube 50 downward, thereby opening the flapper 34.

Figure 7A:
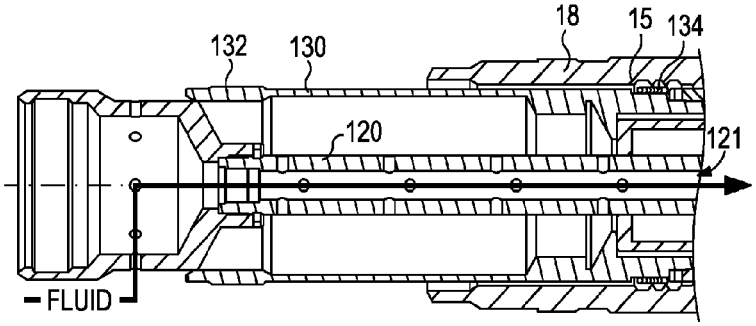

FIG. 7A is a cross-sectional view of the portion of the lockout tool 100 indicated by the dashed line box A in FIG. 7. As illustrated, the seals 134 of the upper guide 130 may be co-located with the no-go profile 15 of the top sub 18, thereby negating any sealing effect in this area. A fluid flow path, as indicated by the arrowed line, exists from the outside of the fishing neck 110 (FIG. 6A) to the flow passage 121 through the center of the plunger shaft 120.

Figure 7B:
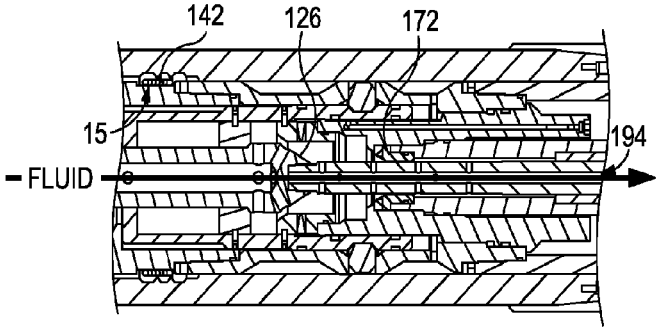

FIG. 7B is a cross-sectional view of the portion of the lockout tool 100 indicated by the dashed line box B in FIG. 7. FIG. 7B shows how the fluid path may continue from the flow passage 121 (FIG. 7A), into the central passage 194 (e.g., a flow bore) of the emergency extractor shaft 190 (FIGS. 6B and 6C).

Figure 7C:
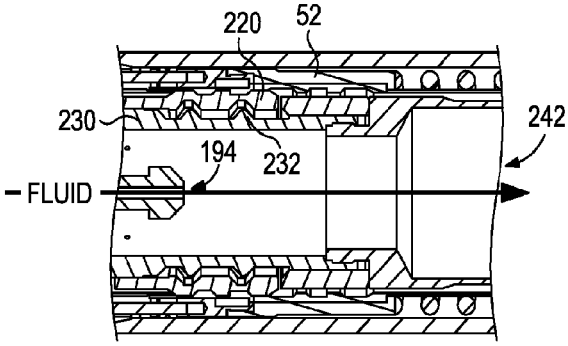

FIG. 7C shows that the ridges 232 may be configured to remain located beneath the relief clearances 222 of the exercise key 220. As illustrated, the flow path continues from the central passage 194 of the tip of the emergency extraction shaft 190 through the opening prong bore 242.

Figure 7D:
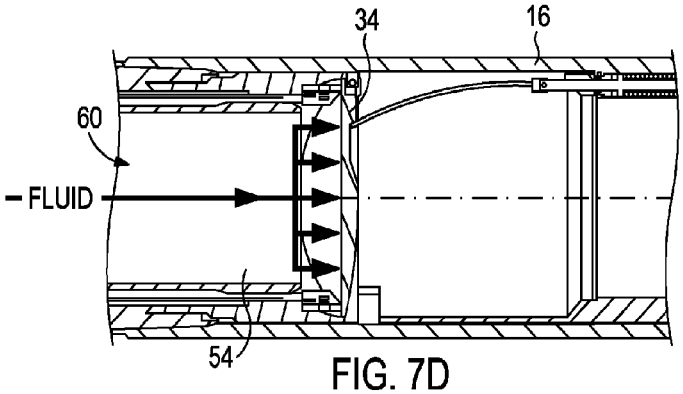

FIG. 7D indicates a pressure build-up that may occur on the upper face of the flapper valve 34 due to the flow path from the top of the lockout tool 100 and down to the flapper valve 34.

Figure 8:
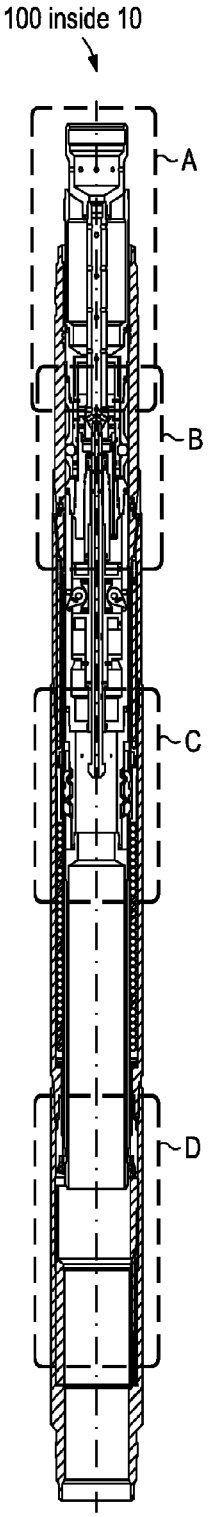
FIG. 8 and the enlarged views in FIGS. 8A-8D show the exemplary lockout tool disposed in the safety valve and configured for a second step in the dimpling operation according to certain aspects of the present disclosure.

FIG. 8 and the enlarged views in FIGS. 8A-8D show the exemplary lockout tool 100 disposed in the safety valve 10 and configured for a second step in the dimpling operation, according to certain aspects of the present disclosure. This configuration occurs after the fluid pressure exhibited on both sides of the flapper valve 34 is equalized, if necessary. In circumstances when the actuation rod 40 is operational, hydraulic pressure supplied to the control line 13 will serve to open the flapper 34 via the engagement with the forcing ring 41 and flow tube 50 (FIGS. 2 and 2C). In circumstances where the flapper 34 cannot be opened by normal procedures, the lockout tool can be "jarred down" to force the opening prong 240 through the closed position of the flapper 34, thereby moving the flapper 34 to its open position.

Figure 8A:
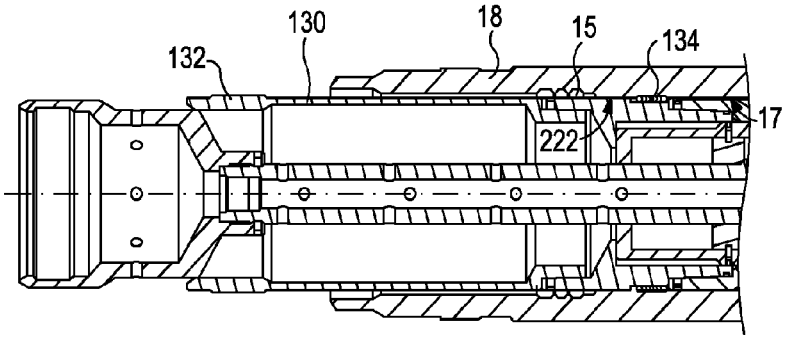

FIG. 8A is a cross-sectional view of the portion of the lockout tool 100 indicated by the dashed line box A in FIG. 8. As illustrated, the lock-out tool 100 has descended within the safety valve 10 (as compared to FIGS. 7A-7D). The seals 134 are now past the no-go profile 15 and are otherwise in contact with the honed bore 17 thereby providing a fluid-tight seal. In certain embodiments, there is a relief clearance 222 that reduces the friction between the upper guide 130 and the top sub 18 in the area of the seals 134. It also can be seen that the no-go stop 132 has not yet descended to or otherwise reached the no-go profile 15.

Figure 8B:
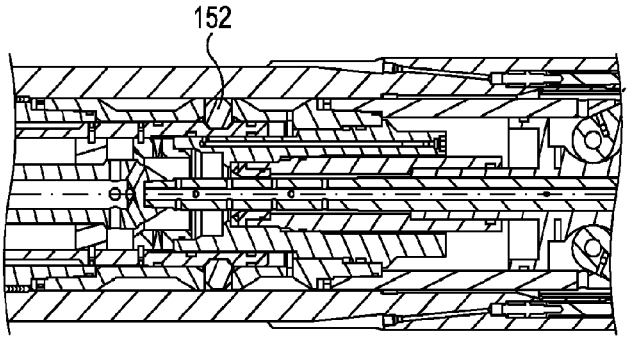

FIG. 8B is a cross-sectional view of the portion of the lockout tool 100 indicated by the dashed line box B in FIG. 8. As illustrated in FIG. 8B, the lugs 152 remain in their unextended configuration.

Figure 8C:
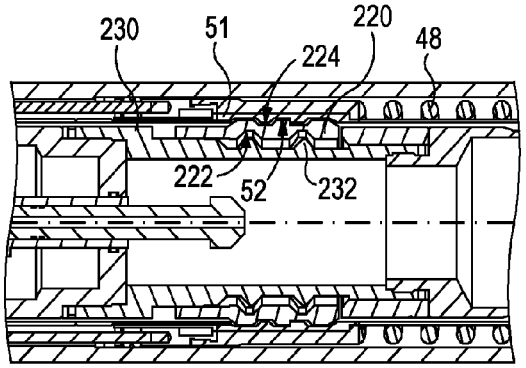

FIG. 8C is a cross-sectional view of the portion of the lockout tool 100 indicated by the dashed line box C in FIG. 8. As illustrated in FIG. 8C, the keying features 224 of the exercise key 220 have engaged the exercise key profile 52 of the center element 51 and the ridges 232 remain located beneath the relief clearances 222 and, therefore, the exercise key 220 may not be locked into the center element 51 at this step. As further illustrated, the closure spring 48 is in its expanded configuration and not yet compressed.

Figure 8D:
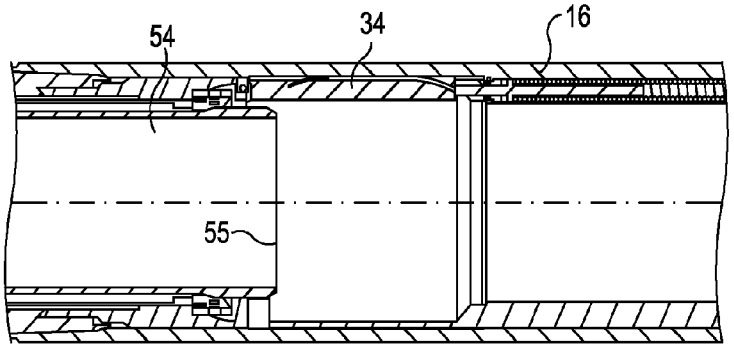

FIG. 8D is a cross-sectional view of the portion of the lockout tool 100 indicated by the dashed line box D in FIG. 8. FIG. 8D illustrates the flapper valve 34 in its open configuration and the lower edge 55 of the lower flow tube 54 has descended past the hinge of the flapper valve 34, thereby opening the flapper valve 34 and holding it in the open configuration.

Figure 9:
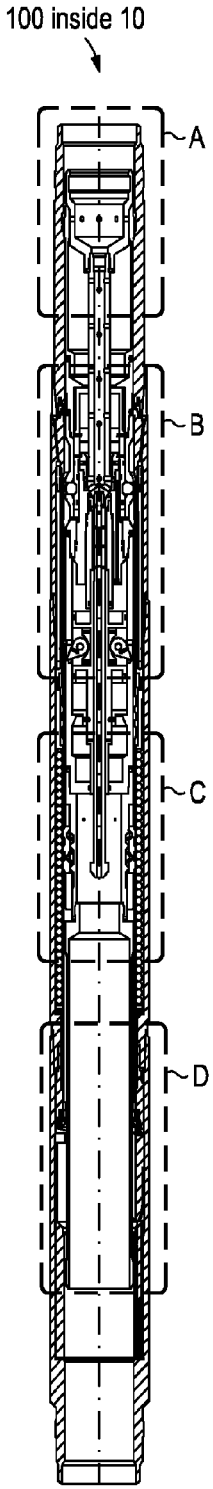
FIG. 9 and the enlarged views in FIGS. 9A-9D show the exemplary lockout tool disposed in the safety valve and configured for a third step in the dimpling operation, according to certain aspects of the present disclosure.

FIG. 9 and the enlarged views in FIGS. 9A-9D show the exemplary lockout tool 100 as disposed in the safety valve 10 and otherwise configured for a third step in the dimpling operation, according to certain aspects of the present disclosure. This step in the process occurs after pressure has been provided from the surface through the control line 13 into drilled passage 18B, which forces the actuation rod 40 downward and compresses the closure spring 48, thereby extending the flow tube 50 past the flapper 34. Alternately, since the keying features 224 of the exercise key 220 of the lockout tool 100 are engaged with the exercise key profile 52 (FIG. 9C) of the safety valve 10, pressure may be applied from the surface through the production tubing 12 to the lockout tool 100 to force the flow tube 50 down to open the flapper 34. Once the flow tube 50 is fully extended and at its downward travel limit, the exercise key 220 of the lockout tool 100 may be restrained from further downward motion by its engagement with the flow tube 50. Further details of these actions that have taken place in this third step are shown in FIGS. 9A-9D.

Figure 9A:
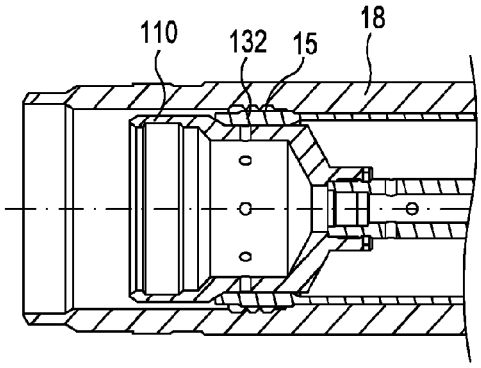

FIG. 9A is a cross-sectional view of the portion of the lockout tool 100 indicated by the dashed line box A in FIG. 9. As illustrated in FIG. 9A, the upper guide 130 has advanced downward within the top sub 18 until the no-go stop 132 engages the no-go profile 15, thereby preventing further descent of the upper guide 130 relative to the safety valve 10. Also shown in FIG. 9A is the fishing neck 110 having further advanced downward to its limit of travel relative to the upper guide 130.

Figure 9B:
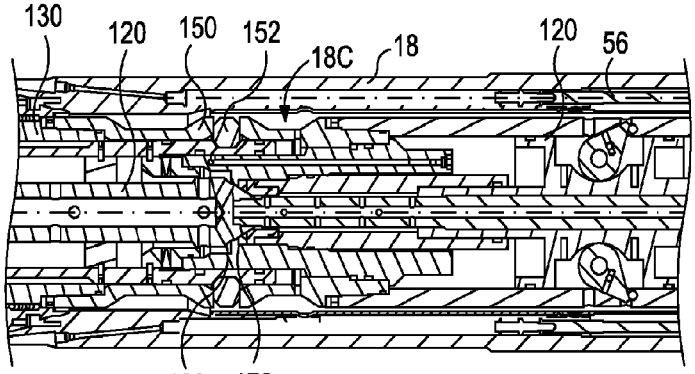

FIG. 9B is a cross-sectional view of the portion of the lockout tool 100 indicated by the dashed line box B in FIG. 9. FIG. 9B shows that the lug carrier 150 has descended far enough that the lugs 152 are extended into the upper end of the recess 18C in the wall of the top sub 18. Recess 18C was formerly occupied by the upper flow tube 56 while in its retracted position, as shown in FIG. 2B. The importance of this location is discussed in greater detail with respect to FIG. 10. In concert with the motion of the fishing neck 110 seen in FIG. 9A, the plunger shaft 120 has moved further downward relative to the upper guide 130 and the nose seal surface 126 is now mated with the pressure seal 172, sealing off the volume below the cam piston 210 (FIGS. 6C and 6D).

Figure 9C:
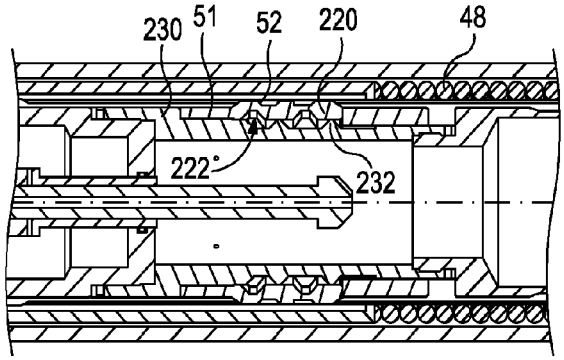

FIG. 9C is a cross-sectional view of the portion of the lockout tool 100 indicated by the dashed line box C in FIG. 9. FIG. 9C shows that the key expander mandrel 230 has been displaced downward such that the key expander ridges 232 are no longer beneath the relief clearance 222 and are in contact with the lower surface of the exercise key 220. This prevents the exercise key 220 from moving inward, thereby locking the exercise key 220 into the exercise key profile 52 of the center element 51 of the flow tube 50. It can be seen that the closure spring 48 is now in its fully compressed configuration.

Figure 9D:
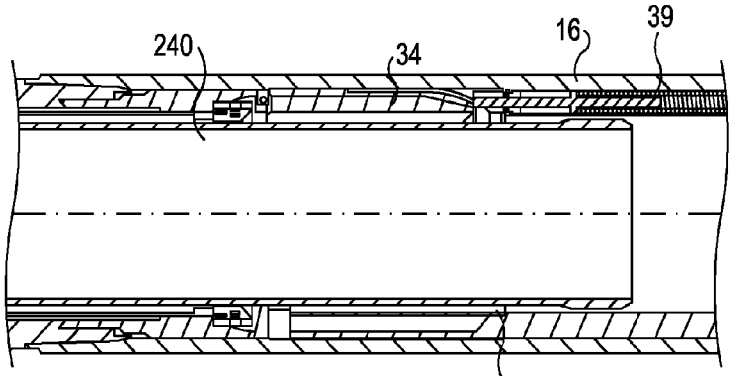

FIG. 9D is a cross-sectional view of the portion of the lockout tool 100 indicated by the dashed line box D in FIG. 9. FIG. 9D shows that the opening prong 240 has advanced below the flapper valve 34. The lower edge 55 of the flow tube 50 is in the fully extended position and the flapper springs 39 are fully compressed.

Figures 10, 10A, 10B:
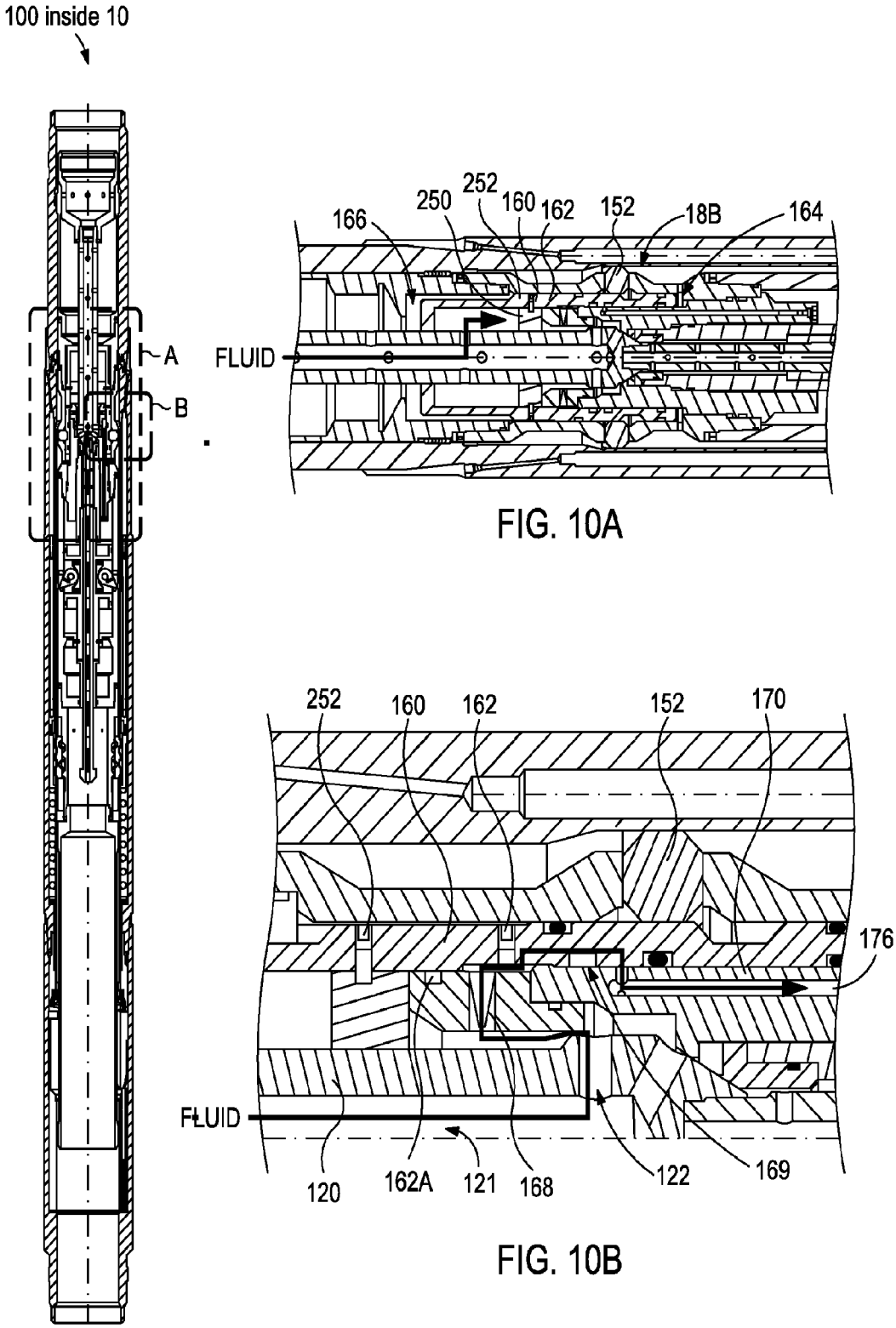
FIG. 10 and the enlarged views
FIGS. 10A-10B show the exemplary lockout tool disposed in the safety valve and configured for a fourth step in the dimpling operation, according to certain aspects of the present disclosure.

FIG. 10 and the enlarged views FIGS. 10A-10B show the exemplary lockout tool 100 disposed in the safety valve 10 and configured for a fourth step in the dimpling operation, according to certain aspects of the present disclosure. This configuration or step occurs after the pressure in the production tubing 12 (FIG. 1) has been increased until the shear pins 162 (FIG. 10A) are broken and the lugs 152 extended.

FIG. 10A is a cross-sectional view of the portion of the lockout tool 100 indicated by the dashed line box A in FIG. 10. FIG. 10A shows how fluid pressure in the production tubing 12 (FIG. 1) reaches the emergency extraction ring 250 that is connected to the lug expander 160 with one or more shear pins 252. The shear pins 162 that connect the lug expander 160 to the upper portion of pressure plug 170 are weaker than the shear pins 252 coupling the lug expander 160 to the extraction ring 250. As the pressure in the production tubing 12 is increased, the shear pins 162 shear, whereupon the pressure on the emergency extraction ring 250 forces the lug expander 160 in the downward direction (i.e., to the right in FIG. 10A). This is visible by the closure of the forward motion volume 164 and the increase in the aft pressure volume 166. As the lug expander 160 moves under the lugs 152, the lugs 152 are extended radially outward into the recess 18C. The downward movement of the lug expander 160 also opens the flow path discussed in greater detail with respect to FIG. 10B. As the lugs 152 cannot extend outward unless the lockout tool 100 is properly positioned in the safety valve 10, i.e. positioned such that the lugs 152 are located proximate to the recess 18C, this may serve as a mechanical interlock preventing operation of the dimpling process if the lockout tool 100 is not properly positioned.

FIG. 10B is a cross-sectional view of the portion of the lockout tool 100 indicated by the dashed line box B in FIG. 10. FIG. 10B shows an enlarged view of the lug expander 160. Specifically, illustrated is a fluid flow path that opens when the lug expander 160 has moved downward. The flow path courses through the flow passage 121 of the plunger shaft 120, through a radial flow passage 122, through a filter 168, past the shear pin(s) 162, through a recess 169 defined on the interior surface of the lug expander 160, and then into the flow channel 176 that leads to the burst disk 174 (FIG. 6C) arranged within the pressure plug 170 at its distal end. The utilization of this path is discussed in greater detail with respect to FIG. 11 below.

FIG. 11 and the enlarged views FIGS. 11A-11B show incremental configurations of the exemplary lockout tool 100 disposed in the safety valve 10 during a fifth step in the dimpling operation, according to certain aspects of the present disclosure. In this step, pressure is increased in the production tubing 12 (FIG. 1) until the burst disk 174 (FIG. 11A) ruptures, whereupon the pressure is applied to the upper face of piston body 211, thereby forcing the piston body 211 downward with respect to the cam housing 200. As the piston body 211 moves downward, the cams 212 may be configured to rotate and thereby plastically deform the upper flow tube 56 and define corresponding dimples 58 therein.

FIG. 11A is a cross-sectional view of the portion of the lockout tool 100 indicated by the dashed line box A in FIG. 11. FIG. 11A shows the configuration of the system at the start of the fifth step, wherein the burst disk 174 is intact. The piston body 211 and the cams 212 are held in position within the cam housing 200 by shear pins 215 through the cams 212. This may prevent the cams 212 from prematurely extending while the lockout tool 100 is being lowered into and positioned within the safety valve 10. Additionally, shear pins 219 between the piston body 211 and the stop disk 217, which is fixed to the cam housing 200, maintains the piston body 211 in place during positioning operations. Pressure in the flow channel 176 defined within the pressure plug 170 is at a pressure sufficient to break the shear pins 162. As this pressure increases, the burst disk 174 is eventually ruptured. Those skilled in the art will readily appreciate that the pressure rating of the burst disk 174 may be selected for each usage of the lockout tool 100 and may depend, at least in part, on the depth of the safety valve 10 and the working pressure in the well at that particular depth.

After the burst disc 174 ruptures, fluid from the production tubing 12 (FIG. 1) may be able to pass through the flow channel 176 and into the cavity 214. To prevent explosive pressurization of the cavity 214, a flow restrictor 178 (FIG. 11B) may be located in the flow channel 176. The piston body 211 may be movably arranged or otherwise floating within the bore of the cam housing 200, and the cavity 216 of the cam housing 200 may be a sealed area at atmospheric pressure. As pressure builds up in the cavity 214, the shear pins 215 and 219 may be sheared and the piston body 211 may be forced or otherwise displaced downward, i.e., to the right in FIG. 11A, and will move towards the configurations depicted in FIG. 11B and FIG. 11D. The cams 212 may be configured to rotate synchronously with the movement of the piston body 211 within the cam housing 200 such that the cams 212 make non-sliding contact with the flow tube 50. In certain embodiments, the orientation of cams 212 may differ such that the high points of some cams 212 are angularly offset from other cams 212 such that a first set of one or more dimples 58 is formed generally on a first common plane perpendicular to the longitudinal up-down axis of the safety valve 10 and one or more dimples 58 are formed generally on one or more secondary planes parallel to and separated from the first common plane.

FIG. 11B is the same cross-sectional view of the portion of the lockout tool 100 as shown in FIG. 11A, but at a later time during the fifth step. In particular, FIG. 11B illustrates the configuration of the lockout tool 100 midway through the fifth step at a position where the dimpling cams 212 are approximately oriented at a 90° angle to the longitudinal up-down axis (FIG. 1) of the safety valve 10. The shear pins 215 and 219 have been sheared, allowing movement of the piston body 211 with respect to the cam housing 200 and rotation of the cams 212. Engagement of the dimpling cams 212 and the upper flow tube 56 may result in corresponding dimples 58 being defined in the upper flow tube 56. The cavity 214 will continue to be pressurized by flow through the flow channel 176 at a rate limited by the flow restrictor 178 and, while the fluid pressure in cavity 216 may increase, it nonetheless remains at a relatively low pressure as compared to the fluid pressure exhibited in the cavity 214.

FIG. 11C depicts a cross-sectional view of the full lockout tool 100 taken along section lines C-C shown in FIG. 11B. In this exemplary embodiment, there are four dimpling cams 212 that may be evenly distributed about the periphery of the lockout tool 100 so as to simultaneously form four evenly spaced dimples 58 in the upper flow tube 56. In other embodiments, however, the dimpling cams 212 may be randomly spaced about the circumference of the lockout tool 100, without departing from the scope of the disclosure. Simultaneous formation of multiple dimples 58 avoids the problem in conventional dimpling tools of the thin-walled upper flow tube 56 distorting into an egg-shape when the dimpling force is applied and therefore a dimple 58 is either not formed or is formed at a reduced size that may not be effective in locking the flow tube 50 into the extended position.

The simultaneous application of a dimpling displacement in multiple locations that are generally on a common plane perpendicular to the longitudinal up-down axis (FIG. 1) of the safety valve 10 reduces the ability of the upper flow tube 56 to distort and therefore will more reliably form properly sized dimples 58. It is even more advantageous to form the dimples 58 in pairs located on opposite sides of the upper flow tube 56. In certain embodiments, other numbers of dimples 58 may be formed, for example three or five or six dimples 58, depending on the application and design constraints known to those skilled in the art. In certain embodiments, two of the plurality of dimples are formed at a separation angle of approximately 180 degrees with respect to each other. In certain embodiments, for example, the dimples 58 may be formed at varying degrees of angular separation about the center of the lockout tool 100. Moreover, in certain embodiments, the dimples 58 may be formed at a plurality of different planes that are perpendicular to the longitudinal up-down axis (FIG. 1) of the safety valve 10.

Figure 11D:
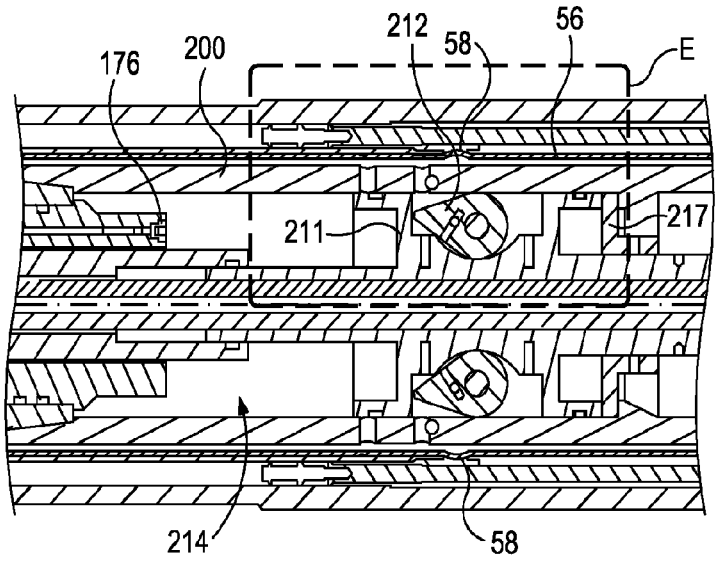

FIG. 11D is the same cross-sectional view of the portion of the lockout tool 100 as shown in FIG. 11A, but at a later time during the fifth step. FIG. 11D illustrates the final configuration of the dimpling process, wherein the piston body 211 has traveled down until it is in contact with the stop disc 217 and the cams 212 have rotated to their final position and are once again fully arranged within the cam housing 200. At this point, further pressurization of pressure cavity 214 is not productive and detection of the end of piston body 211 reaching this position is discussed with respect to FIG. 11E.

Figure 11E:
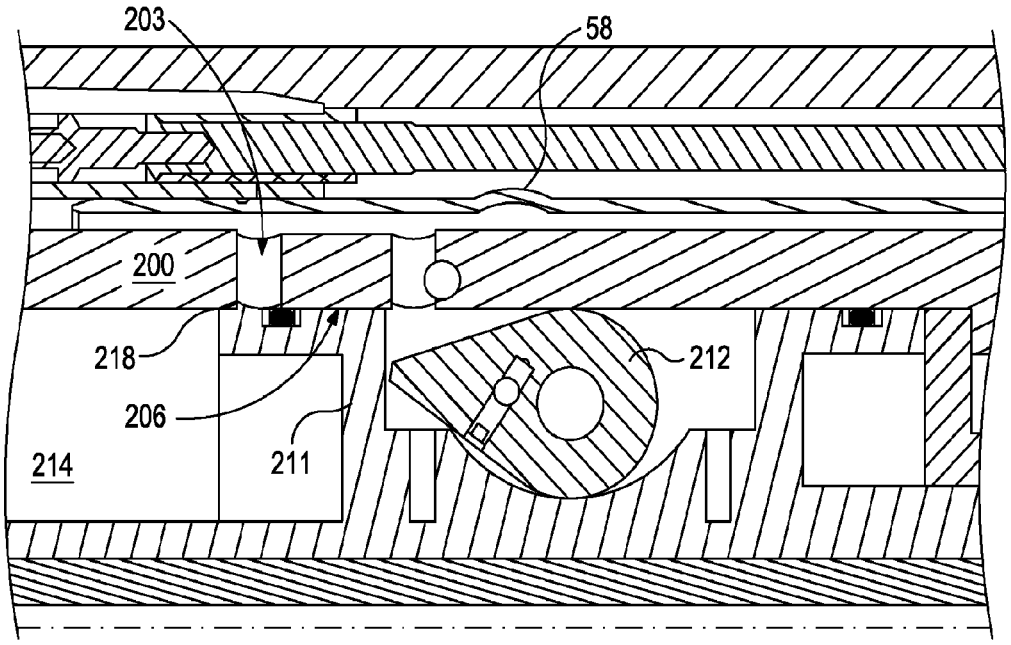

FIG. 11E is an even further enlarged cross-sectional view of the portion of the lockout tool 100 indicated by the dashed line box E in FIG. 11D. FIG. 11E shows that a recess 206 is formed in the inner wall of the cam housing 200. When the cam piston 210 reaches its final position, a clearance is formed between the corner 218 of the piston body 211 and the edge of the recess 206 such that it is no longer possible to maintain pressure in cavity 214 as fluid is capable of escaping the cavity 214 through one or more flow passages 203. The loss of pressure in cavity 216 can be detected by the operators at the surface and may be indicative of a signal that the piston body 211 has completed its downward travel and the dimples 58 have been successfully formed.

Figure 12:
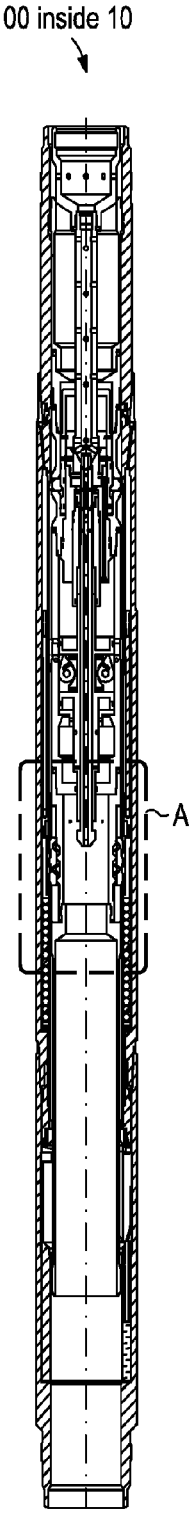
FIG. 12 and the enlarged view in FIG. 12A show the exemplary lockout tool disposed in the safety valve and configured for a sixth step in the dimpling operation, according to certain aspects of the present disclosure.
Figure 12A:
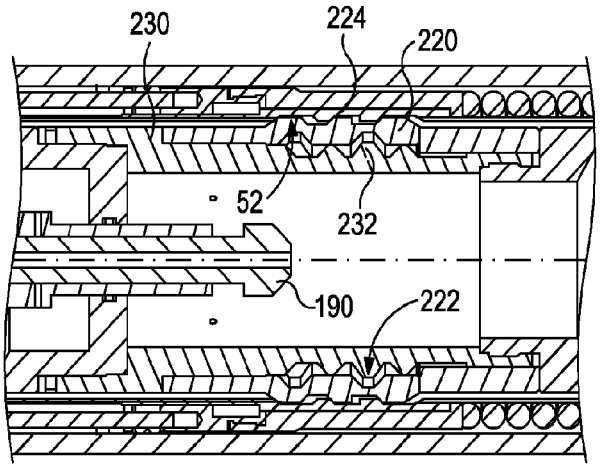

FIG. 12 and the enlarged view in FIG. 12A show the exemplary lockout tool 100 disposed in the safety valve 10 and configured for a sixth step in the dimpling operation, according to certain aspects of the present disclosure. In this step, the operator has applied an upward force to (e.g., "jarred up") the lockout tool 100 through the pulling tool 101 (shown in FIG. 6A) to initiate removal of the lock-up tool 100 from safety valve 10 after the completion of the dimpling operation.

FIG. 12A is a cross-sectional view of the portion of the lockout tool 100 and safety valve 10 indicated by the dashed line box A in FIG. 12. As illustrated in FIG. 12A, the key expander mandrel 230 may be moved upward with respect to the exercise key 220 such that the key expander ridges 232 are again able to be located beneath the relief clearances 222. In this configuration, the exercise key 220 can collapse inward and become disengaged from the exercise key profile 52 (i.e., keying features) of the flow tube 50. Once in this configuration, an upward force on the lock-out tool 100 will thereby disengage the exercise key 220 and the lockout tool 100 can be successfully withdrawn from the safety valve 10.

Figure 13:
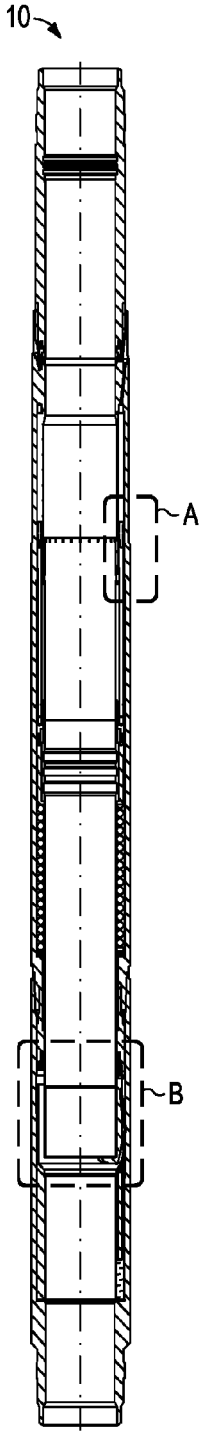
FIG. 13 and enlarged views in FIGS. 13A-13B illustrate the configuration of the safety valve after successful completion of dimpling operation and removal of lockout tool, according to one or more embodiments.
Figure 13A:
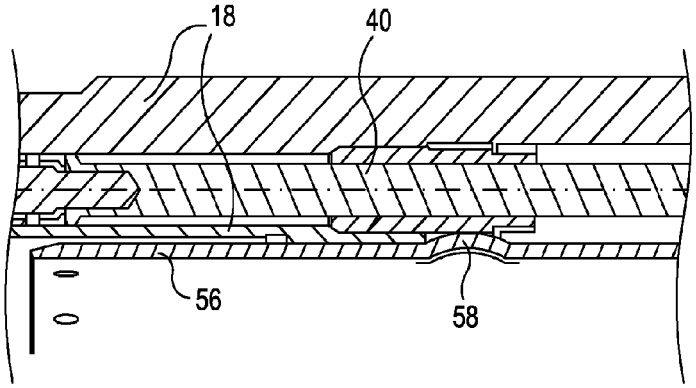
Figure 13B:
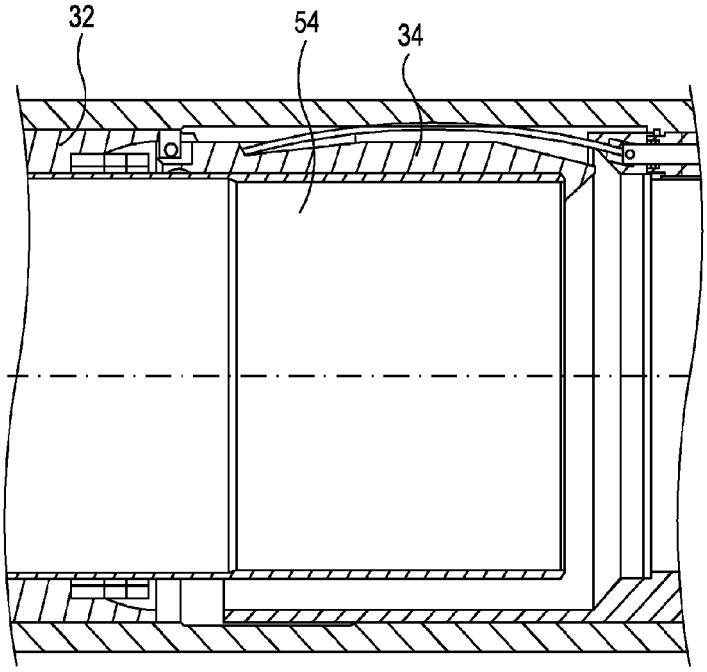

FIG. 13 and enlarged views in FIGS. 13A-13B illustrate the configuration of the safety valve 10 after successful completion of dimpling operation and removal of lockout tool 100.

FIG. 13A is a cross-sectional view of the portion of the safety valve 10 indicated by the dashed line box A in FIG. 13. FIG. 13A shows a portion of the area around the top of the upper flow tube 56, where it is visible that a dimple 58 is in contact with the top sub 18 and interference between the dimple 58 and the top sub 18 prevents further motion of the flow tube 50 upwards relative to the top sub 18. As illustrated, the actuation rod 40 is in its retracted position, as the closure spring 48 (not shown) is being held in its compressed position by the flow tube 50. As a result, loss of pressure in the control line 13 will not result in the actuation of the flapper 34 from its open configuration to its closed configuration.

FIG. 13B is a cross-sectional view of the portion of the safety valve 10 indicated by the dashed line box B in FIG. 13. FIG. 13B shows that the lower flow tube 54 still extends past the flapper 34, thereby maintaining the flapper 34 in its open configuration, even in the absence of control pressure applied to the actuation rod 40. At this point, the presumably damaged safety valve 10 has been disabled and additional work may be done to provide new safety equipment and resume production on the well.

Figure 14:
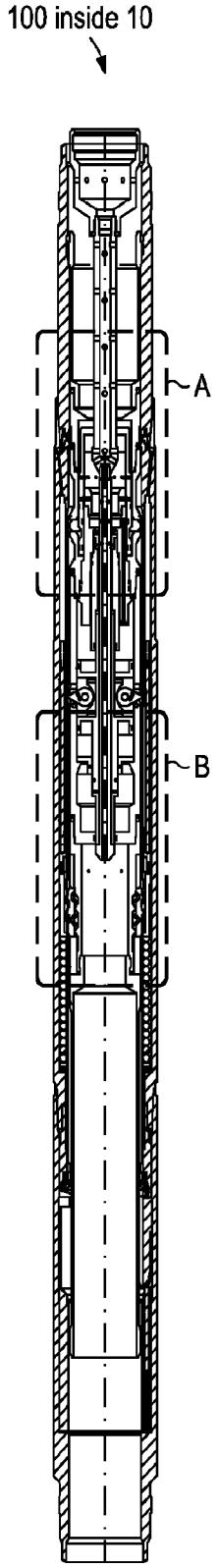
FIG. 14 and the enlarged views
Figure 14A:
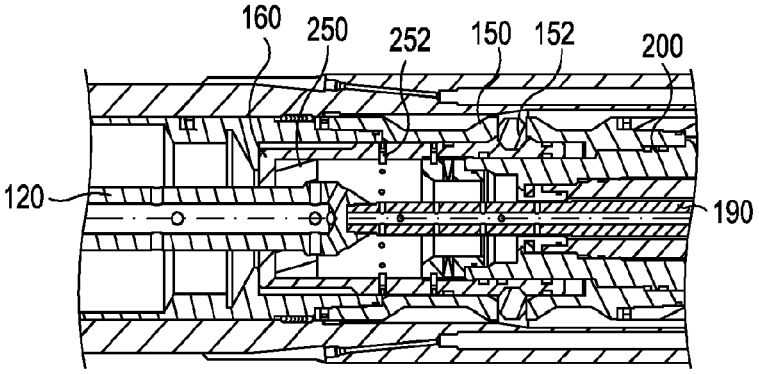
FIGS. 14A-14B show the exemplary lockout tool disposed in the safety valve and configured for an emergency removal during the dimpling operation, according to certain aspects of the present disclosure.
Figure 14B:
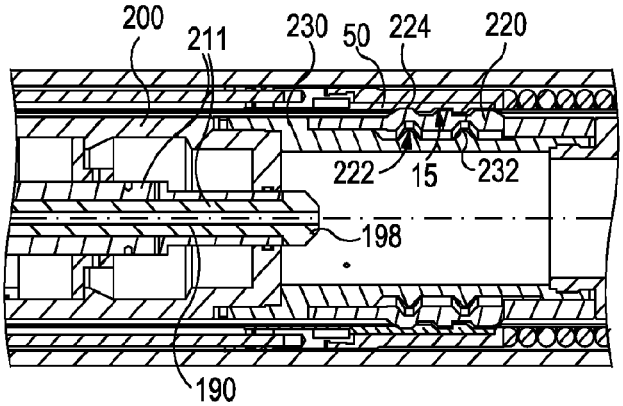

FIG. 14 and the enlarged views FIGS. 14A-14B show the exemplary lockout tool 100 disposed in the safety valve 10 and configured for an emergency removal during the dimpling operation, according to certain aspects of the present disclosure. If a problem occurs during the dimpling operation, the lock-out tool 100 can be removed using the pulling tool 101 (shown in FIG. 6A) even when dimpling has not been successful or the dimpling cams 212 (not shown) have been partially engaged.

FIG. 14A is a cross-sectional view of the portion of the lockout tool 100 indicated by the dashed line box A in FIG. 14. FIG. 14A shows the configuration of the lockout tool 100 after the plunger shaft 120 has been pulled back toward the surface (i.e., to the left in FIG. 14A) until the flared end of the plunger shaft 120 engages the emergency extraction ring 250. At this point, the plunger shaft 120 may be jarred up in order to shear the shear pins 252 that formerly connected the emergency extraction ring 250 to the lug extender body 160. Once the shear pins 252 are sheared, the emergency extraction ring 250 is able to move upward until it comes into contact with the upper end of the lug extender 160. In this position, the lug expander 160 is positioned to allow the lugs 152 to retract and disengage from the top sub 18.

FIG. 14B is a cross-sectional view of the portion of the lockout tool 100 indicated by the dashed line box B in FIG. 14. FIG. 14B shows how the upward movement of the plunger shaft 120, which is coupled to the emergency extraction shaft 190, has caused the emergency extraction shaft 190 to move upward until the flared end 198 of the emergency extraction shaft 190 comes into contact with the piston body 211. Further upward motion of the emergency extraction shaft 190 will bring the piston body 211 into contact with the cam housing 200 such that further upward motion transfers through the cam housing 200 and simultaneously draws the key expander mandrel 230 upwards. Upward motion of the key expander mandrel 230 relative to the exercise key 220, which is locked into the keying features 224 of the flow tube 50 and therefore cannot move with the key expander mandrel 230, moves the key expander ridges 232 to a position under the relief clearances 222. In this configuration, the exercise key 220 is able to collapse and thereby disengage from the keying features 224 of the flow tube 50. With the simultaneous disengagement of the lugs 152 (FIG. 14A) and keying features 224, the lock-out tool 100 is free to be extracted from the safety valve 10 using the pulling tool 101 (FIG. 6A).

The disclosed exemplary lockout tool provides a method and system for forming a plurality of dimples in the flow tube of a safety valve for the purpose of locking the safety valve in an open position. The dimples are formed by a mechanism driven by the controlled application of pressure provided through the production tubing. The lockout tool incorporates no-go features to prevent the tool from damaging the safety valve. The method and system provide feedback to the operators on the surface of successful execution of certain steps in the dimpling process, thereby increasing the confidence of using the lockout tool. The method and system also provide for emergency removal of the lockout tool at any step during the dimpling process.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein.

While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values.

This application includes description that is provided to enable a person of ordinary skill in the art to practice the various aspects described herein. While the foregoing has described what are considered to be the best mode and/or other examples, it is understood that various modifications to these aspects will be readily apparent to those skilled in the art, and the generic principles defined herein may be applied to other aspects. It is understood that the specific order or hierarchy of steps or blocks in the processes disclosed is an illustration of exemplary approaches. Based upon design preferences, it is understood that the specific order or hierarchy of steps or blocks in the processes may be rearranged. The accompanying method claims present elements of the various steps in a sample order, and are not meant to be limited to the specific order or hierarchy presented. Thus, the claims are not intended to be limited to the aspects shown herein, but is to be accorded the full scope consistent with the language claims.

Reference to an element in the singular is not intended to mean "one and only one" unless specifically so stated, but rather "one or more." Use of the articles "a" and "an" is to be interpreted as equivalent to the phrase "at least one." Unless specifically stated otherwise, the terms "a set" and "some" refer to one or more. Moreover, terms such as "top," "bottom," "upper," "lower," "left," "right," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Although the relationships among various components are described herein and/or are illustrated as being orthogonal or perpendicular, those components can be arranged in other configurations in some embodiments. For example, the angles formed between the referenced components can be greater or less than 90 degrees in some embodiments.

The invention claimed is:

1. A method of locking open a safety valve, comprising:

forming simultaneously a plurality of dimples in a flow tube of a safety valve using a lockout tool having a cam housing and a piston disposed within the cam housing, the lockout tool being configured to move relative to the cam housing parallel to a longitudinal up-down axis of the safety valve upon provision of a pressurized fluid within production tubing that is coupled to the safety valve, wherein the piston includes a piston body movable along the longitudinal up-down axis and a plurality of dimpling cams, each dimpling cam providing a high point and being rotatably coupled to the piston body such that the high point protrudes through the cam housing during a portion of rotation of the dimpling cam with respect to the piston body, and each dimpling cam being further configured to synchronously rotate as the piston body moves within the outer shell so that each dimpling cam makes non-sliding contact with the flow tube and the high point of each dimpling cam forms a dimple in the flow tube.

2. The method of claim 1, wherein at least two of the plurality of dimples are formed at a separation angle about the longitudinal up-down axis of the safety valve of at least 90 degrees.

3. The method of claim 2, wherein two of the plurality of dimples are formed at a separation angle of approximately 180 degrees with respect to each other.

4. The method of claim 1, wherein at least two of the plurality of dimples are formed generally on a common plane perpendicular to the longitudinal up-down axis of the safety valve.

5. The method of claim 1, wherein the piston body comprises a face and wherein forming simultaneously the plurality of dimples in the flow tube further comprises allowing the pressurized fluid to flow from the production tubing to the face of the piston body at a controlled rate thereby causing the piston to move along the longitudinal up-down axis and thereby causing the cams to rotate, thereby forming the plurality of dimples in the flow tube.

6. The method of claim 5, further comprising:

introducing the lockout tool into the safety valve; and extending at least one lug outward into a recess of the safety valve so as to allow the pressurized fluid to flow between the production tubing and the face of the piston body, wherein the pressurized fluid is not allowed to flow between the production tubing and the face of the piston body when the at least one lug is not extended.

7. The method of claim 5, wherein the lockout tool is configured such that the at least one lug can be extended only when the lockout tool is properly positioned within the safety valve to form the plurality of dimples in the flow tube.

8. The method of claim 1, wherein forming simultaneously the plurality of dimples in the flow tube further comprises providing the pressurized fluid at a pressure that is greater than or equal to a threshold value.

9. The lockout tool of claim 8, wherein the piston is further configured to form at least two of the plurality of dimples at a separation angle about the longitudinal up-down axis of at least 90 degrees.

10. The lockout tool of claim 9, wherein the piston is further configured to form two of the plurality of dimples at a separation angle of approximately 180 degrees with respect to each other.

11. The lockout tool of claim 8, wherein the piston is further configured to form at least two of the plurality of dimples generally on a common plane perpendicular to the longitudinal up-down axis.

12. The lockout tool of claim 11, wherein the lockout tool is further configured to allow the pressurized fluid to flow from the production tubing to the face of the piston body only after the pressurized fluid reaches a pressure that is greater than or equal to a threshold value.

13. The lockout tool of claim 12, further comprising:

at least one lug movably coupled to the cam housing and being configured to extend outward from the lockout tool into a recess of the safety valve when the lockout tool is properly positioned within the safety valve and the flow tube is in the extended position; and a lug expander movably coupled to the cam housing and configured to move parallel to the longitudinal up-down axis of the safety valve when the pressurized fluid is provided through the production tubing and thereby extend the at least one lug outward, wherein the lockout tool is configured such that the piston body cannot be moved relative to the cam housing unless the at least one lug is extended.

14. A lockout tool comprising:

a cam housing configured to fit within a flow tube of a safety valve that is coupled to production tubing and has a longitudinal up-down axis; and a piston disposed within the cam housing and configured to move within the cam housing parallel to the longitudinal up-down axis and form a plurality of dimples in the flow tube upon provision within the production tubing of a pressurized fluid, wherein the piston includes a piston body movable within the cam housing parallel to the longitudinal up-down axis and a plurality of dimpling cams rotatably coupled to the piston body, each dimpling cam providing a high point and being configured to synchronously rotate as the piston body moves within the cam housing and make non sliding contact with the flow tube such that the high point forms a dimple in the flow tube.

15. The lockout tool of claim 14, wherein:

the piston body further comprises a face; and the lockout tool further comprises a flow restrictor configured to limit the rate of flow of the pressurized fluid from the production tubing to the face of the piston body, wherein the lockout tool is configured such that fluid flowing from the production tubing to the face of the piston body must pass through the flow restrictor, and wherein the piston body is further configured to move within the outer shell parallel to the longitudinal up-down axis upon provision of the pressurized fluid to the face.

16. The lockout tool of claim 15, further comprising at least one lug configured to extend outward into a recess of the safety valve so as to allow the pressurized fluid to flow from the production tubing to the face of the piston body, wherein the pressurized fluid cannot flow from the production tubing to the face of the piston body when the at least one lug is not extended.

17. The lockout tool of claim 16, wherein the lockout tool is configured such that the at least one lug can be extended only when the lockout tool is properly positioned within the safety valve to form the plurality of dimples in the flow tube.

18. A lockout tool comprising:

a cam housing configured to fit within a flow tube of a safety valve that is coupled to production tubing, wherein the flow tube includes a center element having an exercise key profile and an upper flow tube coupled to the center element;

an exercise key movably coupled to the cam housing and configured to selectably engage the exercise key profile;

an opening prong fixedly coupled to the cam housing and configured to move a flapper of the safety valve to an open position and allow the flow tube to move to an extended position that generally retains the flapper in the open position;

a piston body disposed within the cam housing so as to be generally within the upper flow tube when the lockout tool is operably disposed within the safety valve and the flow tube is in the extended position, the piston body configured to move within the housing parallel to a longitudinal up-down axis of the safety valve when a pressurized fluid is provided through the production tubing; and a plurality of cams rotatably coupled to the piston body, the plurality of cams each comprising a high point and configured to synchronously rotate as the piston body moves relative to the cam housing such that the high points each locally deform the upper flow tube.

19. The lockout tool of claim 18, wherein provision of a pressurized fluid in the production tubing causes the lockout tool to:

open the flapper;

engage the exercise key profile;

move the flow tube to the extended position; and move the piston relative to the camp housing so as to form a plurality of dimples in the upper flow tube in locations that generally retain the flow tube in the extended position.

* * * * *